US010702117B2

(12) United States Patent
Hansen

(10) Patent No.: US 10,702,117 B2
(45) **Date of Patent: *Jul. 7, 2020**

(54) GROUT CLEANING TOOL

(71) Applicant: BISSELL Homecare, Inc., Grand Rapids, MI (US)

(72) Inventor: Eric J. Hansen, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/176,324

(22) Filed: Oct. 31, 2018

(65) Prior Publication Data

US 2019/0059682 A1 Feb. 28, 2019

Related U.S. Application Data

(60) Continuation of application No. 15/236,892, filed on Aug. 15, 2016, now Pat. No. 10,159,394, which is a division of application No. 14/026,334, filed on Sep. 13, 2013, now Pat. No. 9,420,932.

(60) Provisional application No. 61/701,937, filed on Sep. 17, 2012.

(51) Int. Cl.

| | |
|---|---|
| ***A47L 13/22*** | (2006.01) |
| ***A47L 13/17*** | (2006.01) |
| ***A47L 11/34*** | (2006.01) |
| ***A47L 11/40*** | (2006.01) |
| ***A47L 13/12*** | (2006.01) |

(52) U.S. Cl.

CPC ..... *A47L 13/12* (2013.01); *A47L 11/34* (2013.01); *A47L 11/4047* (2013.01); *A47L 11/4086* (2013.01); *A47L 13/17* (2013.01); *A47L 13/225* (2013.01)

(58) Field of Classification Search

CPC ..... A47L 13/12; A47L 11/34; A47L 11/4047; A47L 11/4086; A47L 13/225; A47L 13/17; A47L 11/40; A47L 13/22

USPC ..... 15/320, 403

See application file for complete search history.

(56) References Cited

U.S. PATENT DOCUMENTS

| | | | |
|---|---|---|---|
| 6,059,475 | A | 5/2000 | Jafarmadar |
| 6,584,990 | B2 | 7/2003 | Shaw |
| 7,743,810 | B2 | 6/2010 | Rolion et al. |

(Continued)

FOREIGN PATENT DOCUMENTS

| | | | |
|---|---|---|---|
| CN | 2482956 | Y | 3/2002 |
| CN | 201085588 | A | 7/2008 |

(Continued)

OTHER PUBLICATIONS

BISSELL Steam Mop™ Deluxe Model 31N1 User's Guide, 12 pages, dated 2010.

(Continued)

*Primary Examiner* — David Redding

(74) *Attorney, Agent, or Firm* — McGarry Bair PC

(57) ABSTRACT

A grout cleaning tool includes a grout cleaning tape. The grout cleaning tape can be provided as a replaceable grout cleaning cartridge containing a supply reel of grout cleaning tape that can be rolled across grout line grooves with an applicator roller. The grout cleaning tape can include a composition therein that is configured to be activated or enhanced by steam and transferred into the grout line to be cleaned when steam is applied to the tape.

20 Claims, 4 Drawing Sheets

(56) References Cited

U.S. PATENT DOCUMENTS

| | | | |
|---|---|---|---|
| 8,458,850 | B2 | 6/2013 | Kasper et al. |
| 9,320,405 | B2 | 4/2016 | Luedke et al. |
| 10,159,394 | B2 * | 12/2018 | Hansen ..... A47L 13/12 |
| 2003/0159223 | A1 | 8/2003 | Plankenhorn |
| 2006/0074003 | A1 | 4/2006 | Martin et al. |
| 2006/0254017 | A1 | 11/2006 | Knopow et al. |
| 2007/0088301 | A1 | 4/2007 | Ikeda et al. |
| 2008/0229530 | A1 | 9/2008 | Kordick |
| 2011/0145191 | A1 | 6/2011 | Anderson et al. |
| 2012/0145191 | A1 | 6/2012 | Williams et al. |
| 2013/0318725 | A1 | 12/2013 | Kellis et al. |

FOREIGN PATENT DOCUMENTS

| | | | |
|---|---|---|---|
| CN | 101252868 | A | 8/2008 |
| CN | 101273863 | A | 10/2008 |
| CN | 101884514 | A | 11/2010 |
| CN | 102525352 | A | 7/2012 |
| CN | 202288170 | U | 7/2012 |
| EP | 2263509 | A2 | 12/2010 |
| GB | 2420268 | B | 5/2006 |
| WO | 2006046044 | A1 | 4/2006 |
| WO | 2006083683 | A3 | 8/2006 |
| WO | 2011019814 | A2 | 2/2011 |

OTHER PUBLICATIONS

Claus Blumenberg, European Search Report, 7 pages dated Jun. 22, 2018, Munich, Germany.

Zhu Chen, Notification of the First Office Action, dated Dec. 2, 2016, 8 pages, People's Republic of China.

* cited by examiner

GROUT CLEANING TOOL

CROSS-REFERENCE TO RELATED APPLICATIONS

This application is a continuation of U.S. patent application Ser. No. 15/236,892, filed Aug. 15, 2016, now U.S. Pat. No. 10,159,394, which is a division of U.S. patent application Ser. No. 14/026,334, filed Sep. 13, 2013, now U.S. Pat. No. 9,420,932, issued Aug. 23, 2016, which claims the benefit of U.S. Provisional Patent Application No. 61/701,937, filed Sep. 17, 2012, all of which are incorporated herein by reference in their entirety.

BACKGROUND

Devices such as steam mops and handheld steamers are configured for cleaning a wide variety of common household surfaces such as bare flooring, including tile, hardwood, laminate, vinyl, and linoleum, as well as countertops, stove tops and the like. Typically, steam mops comprise at least one tank or reservoir for storing liquid that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a distributor nozzle or a manifold located in a foot or cleaning head that engages the surface to be cleaned. Steam is typically applied to the backside of a cleaning pad that is removably attached to the cleaning head. Steam eventually saturates the cleaning pad and the damp pad is wiped across the surface to be cleaned to remove dirt, dust, and debris present on the surface, thereby collecting and absorbing soil and soiled cleaning composition into the pad.

Additionally, auxiliary compositions, such as fragrances, detergents or other additives can be supplied via the liquid tank for distribution through the surface cleaning apparatus to improve cleaning efficacy or to provide other sensory benefits. Alternatively, these auxiliary compositions can be impregnated, embedded, encapsulated within, or otherwise affixed to the cleaning pad. Steam from the steam distributor nozzle can release the composition onto the surface to be cleaned.

Some steam appliances locate a removable water supply tank and a steam generating device on an upright handle and deliver steam through a universal joint to a pivoting cleaning foot that is typically covered by a reusable cleaning pad. One example is the BISSELL Steam Mop™ Deluxe (Model 31N1). Details of a similar steam mop device are disclosed in Chinese Patent No. CN2482956 to Wu, issued Mar. 27, 2002. In an alternate configuration, the steam generator can be located on the cleaning head as disclosed in U.S. Pat. No. 6,584,990 to Shaw, issued Jul. 1, 2003.

Other steam appliances include a fluid distribution system that incorporates an auxiliary hand tool for steam cleaning above-floor surfaces. The auxiliary hand tool is fluidly connected to a fluid conduit that guides steam from the steam generator to a steam outlet in the auxiliary hand tool as more fully disclosed in International Application No. PCT/US10/45167, filed Aug. 11, 2010, titled "Upright Steam Mop with Auxiliary Hand Tool", published as WO2011/019814, which is assigned to BISSELL Homecare, Inc.

The use of tile as floor and wall coverings has become increasingly popular in recent years. A typical floor tile installation comprises a plurality of tiles bonded to an underlying subfloor by a bonding material, including mortar and grout. Typically, tiles are mounted to a subfloor and spaced apart such that a gap exists between adjacent tiles. The gap can ordinarily range from about ⅛ inch to ¾ inch wide. These gaps are filled with grout, which results in a network of grout lines between the tiles. The grout lines can be recessed slightly below the tile surface in the form of grooves, which tend to collect soil and are difficult to clean because mop pads, including steam mop pads, tend to scrub along the top surface of the tile and miss the recessed grout lines.

U.S. Pat. No. 6,059,475 to Jafarmadar, issued May 9, 2000, discloses multiple embodiments of a grout cleaning apparatus. The disclosed devices generally include a fluid delivery system that includes a liquid reservoir, a flow control valve and a liquid dispensing head mounted to a handle. An agitator on the head is configured to scrub grout joints. The agitator can comprise a stationary brush mounted on the head or, alternatively, a rotatably mounted brush wheel that is operably connected to an electric motor.

SUMMARY

In one aspect, the disclosure relates to a grout cleaning cartridge for a surface cleaning apparatus having a steam generator and a foot movable along a surface to be cleaned. The grout cleaning cartridge can include a housing configured to be mounted to the foot, an applicator roller carried by the housing, a supply reel rotatably carried by the housing, a take-up reel rotatably carried by the housing, and a grout cleaning tape provided on the supply reel, wound around the applicator roller, and coupled to the take-up reel, wherein, when the housing is mounted to the foot, advancement of the foot along a surface to be cleaned advances the grout cleaning tape around the application roller and into contact with the surface to be cleaned.

In another aspect, the disclosure relates to a grout cleaning cartridge for a surface cleaning apparatus having a steam generator and a foot movable along a surface to be cleaned. The grout cleaning cartridge can include a housing configured to be detachably mounted to the foot in register with a steam outlet fluidly coupled to the steam generator, an applicator roller carried by the housing, a supply reel rotatably carried by the housing, a take-up reel rotatably carried by the housing, and a grout cleaning tape provided with a grout cleaning composition, the grout cleaning tape provided on the supply reel, wound around the applicator roller, and coupled to the take-up reel. When the housing is mounted to the foot, the grout cleaning cartridge is configured to allow steam from the steam outlet to pass through the grout cleaning tape onto the surface to be cleaned, and advancement of the foot along the surface to be cleaned advances the grout cleaning tape around the application roller and into contact with the surface to be cleaned, transferring the grout cleaning composition from the grout cleaning tape to the surface, and after the grout cleaning composition has been transferred a remainder of the grout cleaning tape is collected on the take-up reel.

DETAILED DESCRIPTION

Aspects of the present disclosure generally relate to a surface cleaning apparatus with heat and cleaning composition delivery and, more specifically, to an apparatus for cleaning tile grout joints, such as the joints formed between tiles on surfaces such as floors or walls.

Figure 1:
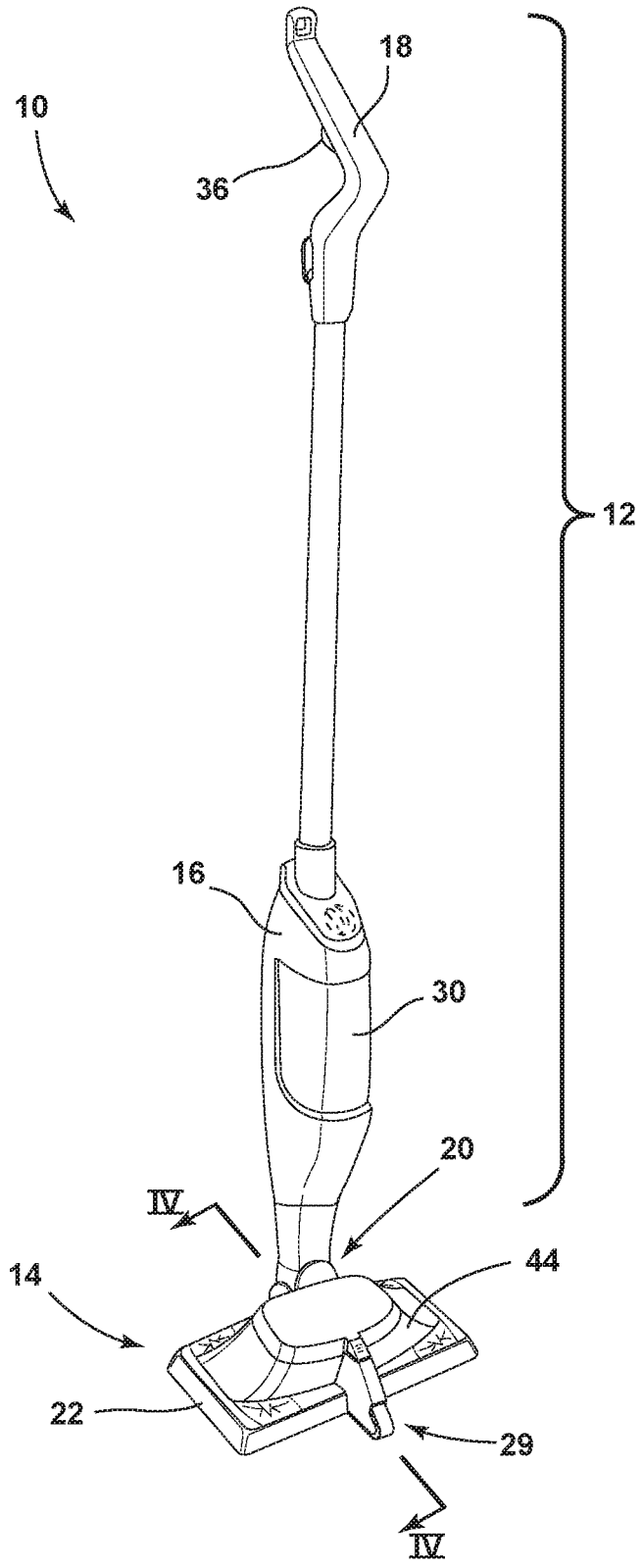
FIG. 1 is a front perspective view of a surface cleaning apparatus in the form of a steam appliance according to an aspect of the present disclosure.

FIG. 1 is a front perspective view of a surface cleaning apparatus in the form of a steam appliance 10 according to a first embodiment of the invention. The steam appliance 10 comprises an upright handle assembly 12 mounted to a cleaning foot assembly 14. The upright handle assembly 12 further comprises a handle housing 16 located between a handle grip 18 and a joint 20. The cleaning foot assembly 14 is removably attached to the joint 20 to moveably mount the foot assembly 14 to the handle assembly 12. In one embodiment, the joint 20 can comprise a universal joint 20, such that the foot assembly 14 can pivot about at least two axes relative to the handle housing 16

Figure 4:
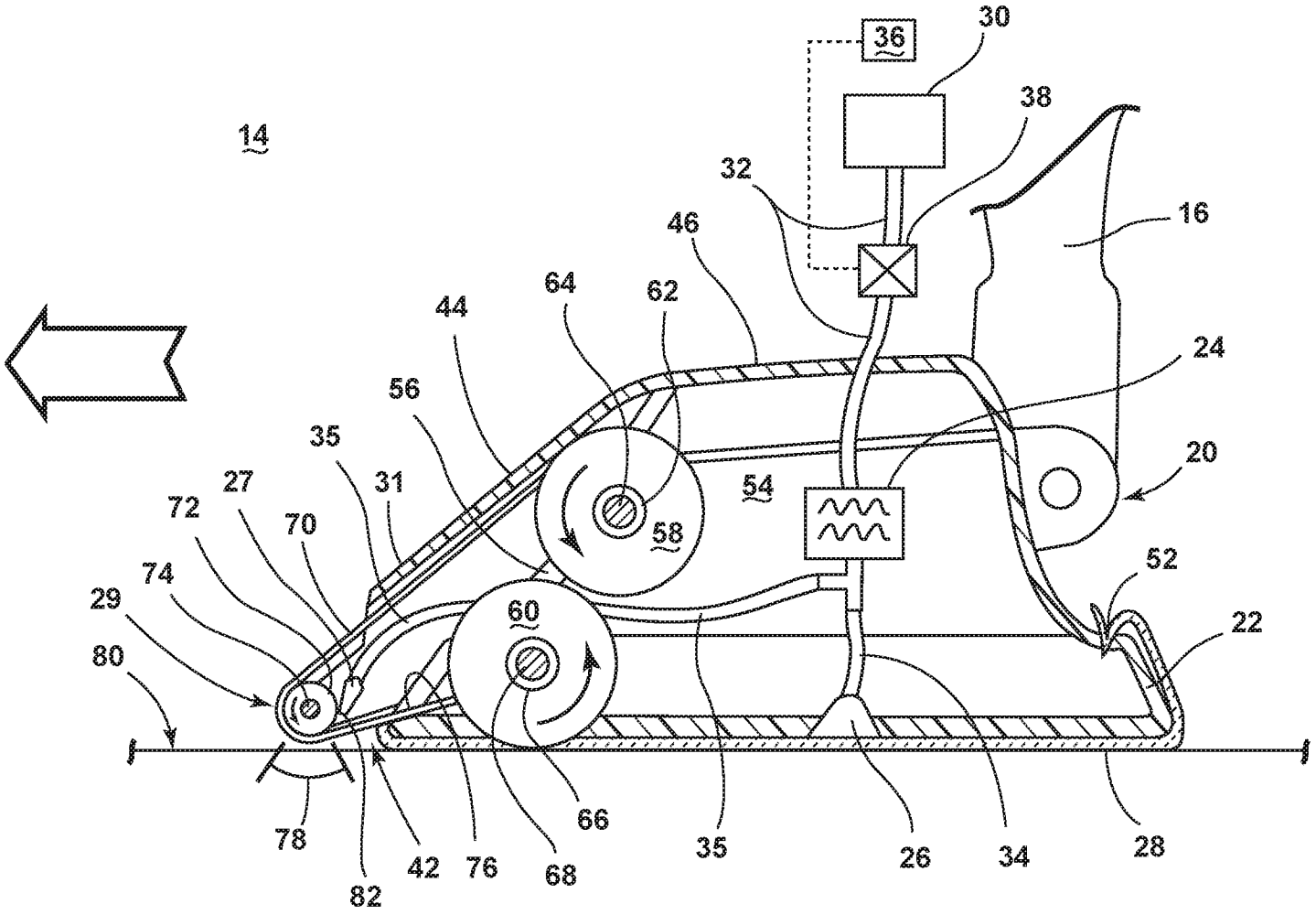
FIG. 4 is a schematic, partial cross-sectional view of the foot assembly of FIG. 2 taken along line with the cleaning pad attached to the foot assembly and portion of a fluid delivery system of the steam appliance shown schematically.

With reference to FIG. 4, the foot assembly 14 further comprises a steam frame 22, a steam generator 24, a first steam outlet 26 at a bottom portion of the steam frame 22, and a second steam outlet 27 at a forward portion of the steam frame 22. A cleaning pad 28 is removably attached to a lower surface of the steam frame 22. The bottom of the steam frame 22 can further comprise a plurality of steam delivery channels (not shown) that are fluidly connected to the first steam outlet 26 for distributing steam to the top side of the cleaning pad 28. A replaceable grout cleaning cartridge 29 is mounted within a shroud 31 near the front portion of the steam frame 22. The cleaning pad 28 does not substantially cover the grout cleaning cartridge 29.

The handle housing 16 further accommodates a portion of a fluid delivery system comprising a cleaning solution reservoir 30 that is configured to distribute cleaning solution to downstream portions of the fluid delivery system. Optionally, the fluid delivery system can comprise multiple solution reservoirs as more fully described in U.S. application Ser. No. 13/788,957, filed Mar. 7, 2013, now U.S. Pat. No. 9,320,405, titled "Surface Cleaning Apparatus", which is assigned to BISSELL Homecare, Inc. and incorporated herein by reference in its entirety. A solution conduit 32 fluidly connects the cleaning solution reservoir 30 to the steam generator 24 for conveying liquid from the reservoir 30, through the universal joint 20, and into the steam generator 24. A first steam conduit 34 fluidly connects the steam generator 24 to the first steam outlet 26 for conveying steam generated by the steam generator 24 onto a top surface of the cleaning pad 28. A second steam conduit 35 fluidly connects the steam generator 24 to the second steam outlet 27, which is in register with the grout cleaning cartridge 29.

The steam generator 24 can comprise an in-line flash heater. Alternatively, the steam generator can be mounted within the foot assembly 14. Examples of suitable steam generators for mounting within the foot of a steam mop are more fully described in U.S. Pat. No. 6,584,990 to Shaw and U.S. application Ser. No. 13/836,630, filed Mar. 15, 2013, now U.S. Pat. No. 9,420,933, titled "Surface Cleaning Apparatus", assigned to BISSELL Homecare, Inc., which are both incorporated herein by reference in their entirety.

A trigger 36 is pivotally mounted to the handle grip 18 (FIG. 1) and is accessible for selective engagement by a user. The trigger 36 is operably coupled to a valve 38 that is fluidly connected between the solution conduit 32 and steam generator 24 for selectively controlling flow of solution from the cleaning solution reservoir 30 to the steam generator 24. In one embodiment, the trigger 36 can be connected to an upper end of a push rod (not shown) that is slidably mounted within the handle housing 16, with a bottom end of the push rod in register with the valve 38.

Additional examples of steam mops, steam mop pads and cleaning methods that may be used with embodiments of the invention described herein include the BISSELL Steam Mop™, sold in the United States by BISSELL Homecare, Inc. and International Application No. PCT/US10/45167, filed Aug. 11, 2010, published as WO2011/019814, titled "Upright Steam Mop with Auxiliary Hand Tool" and U.S. application Ser. No. 12/778,615, filed May 12, 2010, now U.S. Pat. No. 8,458,850, titled "Upright Steam Mop Sweeper" and U.S. application Ser. No. 13/788,957, filed Mar. 7, 2013, now U.S. Pat. No. 9,320,405, titled "Surface Cleaning Apparatus" and U.S. application Ser. No. 13/323,286, filed Dec. 12, 2011, now U.S. Pat. No. 8,927,480, titled "Cleaning Cloth with Encapsulated Formulation, Steam Mop and Method", all of which are assigned to BISSELL Homecare Inc. and which are herein incorporated by reference in their entirety.

Figure 2:
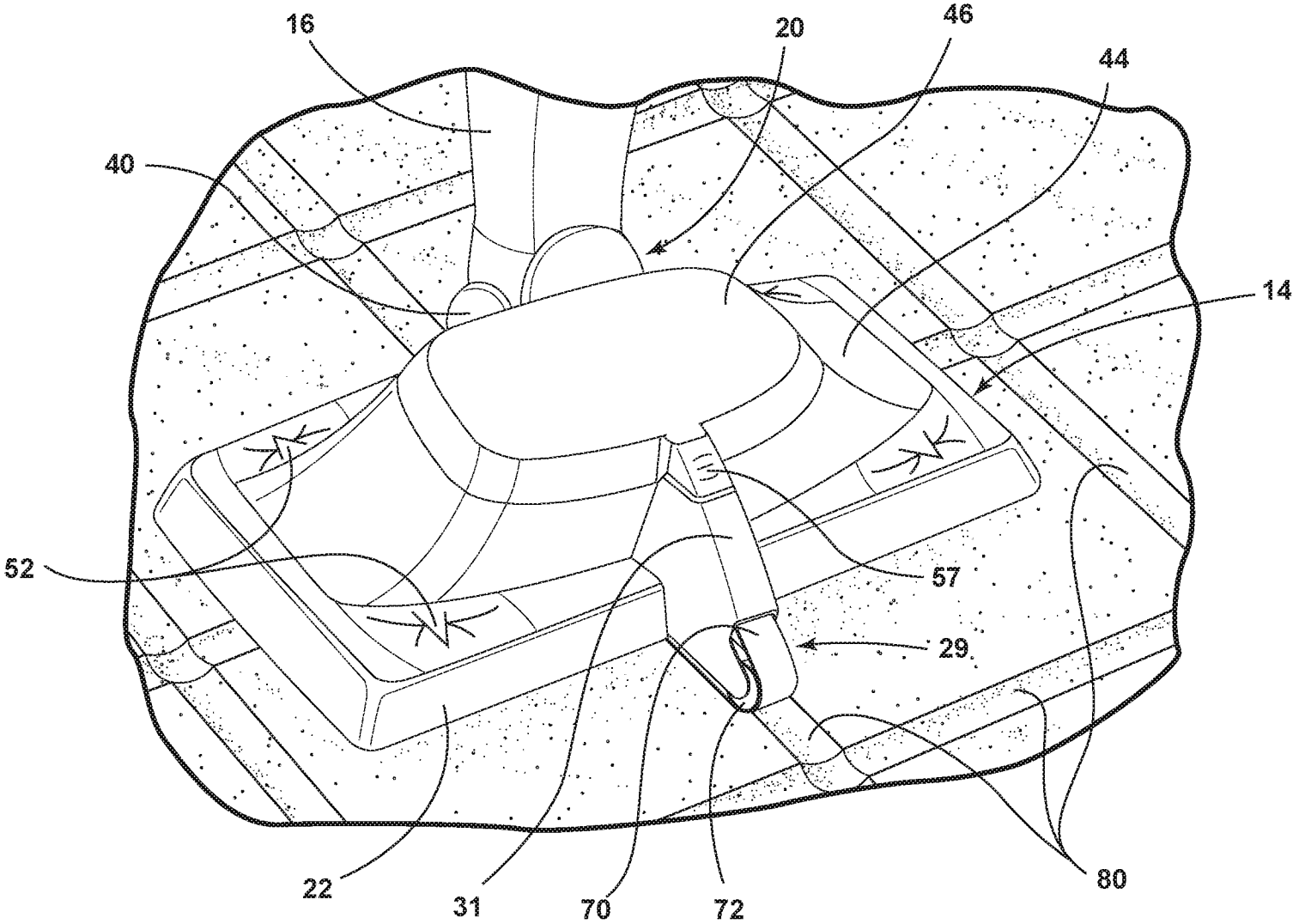
FIG. 2 is a partial perspective view of the foot assembly of the steam appliance of FIG. 1 shown on a tile flooring surface.

FIG. 2 is a partial front perspective view of the cleaning foot assembly 14. The cleaning pad 28 is not shown for clarity. The universal joint 20 is pivotally mounted to corresponding bosses 40 on the upper rear portion of a cover 44, which is fastened to the top of the steam frame 22. The universal joint 20 is configured to rotate back and forth about a first horizontal axis that extends laterally through the sides of the steam mop, and from side to side about a second horizontal axis that extends from front to back, orthogonal to the first axis.

The cleaning foot assembly 14 can be interchangeable, and can be detachably mounted to the universal joint 20. The foot assembly 14 can be detached from the universal joint 20, and a substitute cleaning foot assembly (not shown) can be installed onto the joint 20 and fluidly connected to the solution conduit 32 via mating fluid fittings (not shown) in the handle housing 16 and foot assembly 14, respectively.

With reference to FIG. 4, the cover 44 comprises a generally rectangular housing with a raised central portion 46, which forms a cavity 54 therein when the cover 44 is mounted to the steam frame 22 for housing the steam generator 24 and the grout cleaning cartridge 29. The cover 44 can further comprise sheet retainers 52 that are configured to hold a portion of the cleaning pad 28 in register with the foot assembly 14.

Figure 3:
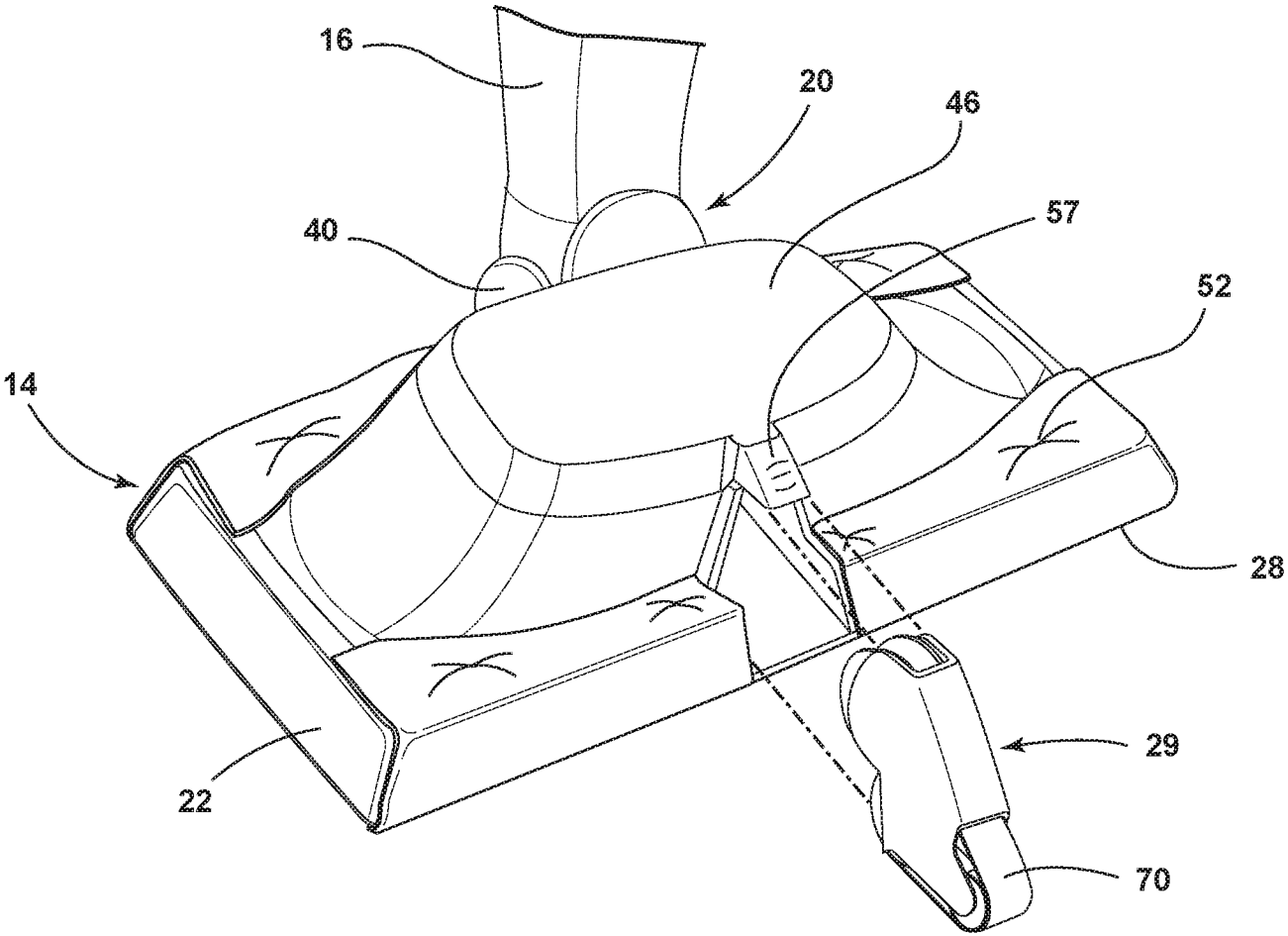
FIG. 3 is a partial perspective view of the foot assembly of the steam appliance of FIG. 1 shown with the grout cleaning cartridge detached from the foot assembly.

As best shown in FIGS. 2-4, the grout cleaning cartridge 29 comprises a support frame 56 that can be detachably mounted to the foot assembly 14. The support frame 56 can be secured to the shroud 31 on the front portion of the cover 44 by a retention feature, which is shown herein as a release button 57 for exemplary purposes. The release button 57 can comprise a catch (not shown) for selectively engaging and retaining a corresponding hook (not shown) on the grout cleaning cartridge 29. The release button 57 can be slidably mounted to the cover 44 and can be spring biased upwardly to engage the catch and the hook. The button 57 can be configured to release the cartridge 29 when a user depresses the button 57, which disengages the catch from the hook and releases the cartridge 29 so that a user can slide the cartridge out of an opening 42 formed in the steam frame 22. Alternative retention features are also contemplated, such as mechanical fasteners or snaps on one or a combination of the support frame 56, cover 44 and steam frame 22, for example.

The support frame 56 is configured to rotatably support a cleaning tape supply reel 58 and a take-up reel 60 thereon. The supply reel 58 comprises a first hub 62 that is rotatably mounted to a first support pin 64 on the support frame 56. Likewise, the take-up reel 60 comprises a second hub 66 that is rotatably mounted to a second support pin 68 on the support frame 56. The supply reel 58 and take-up reel 60 can be formed of a rigid thermoplastic material and can be operably connected together by a length of cleaning tape 70 wrapped between the supply reel 58 and take-up reel 60. The cleaning tape 70 can be provided initially wound around the supply reel 58. A free end of the cleaning tape 70 can be captured in a slot (not shown) on the take-up reel 60. Although not shown in the figures, it is contemplated that the grout cleaning cartridge 29 can comprise a mechanical drive system interconnecting an applicator roller 72 with the supply reel 58 and take-up reel 60. For example, the aforementioned components can be interconnected by a spur gear drive train to ensure unitary movement of the respective components. It is also within the scope of the invention to incorporate a ratcheting mechanism to control the paying out of cleaning tape 70 from the supply reel 58 reel and subsequent collection of the spent tape 70 on the take-up reel 60. Thus, the supply reel 58 and take-up reel 60 are operably connected together by the cleaning tape 70 and mechanical drive system (not shown) and configured to rotate around the first and second support pins 64, 68 in unison.

An applicator roller 72 is rotatably mounted to a third support pin 74 located on a forward portion of the support frame 56. The applicator roller 72 is configured to contact an inner surface 76 of the cleaning tape 70, so that as cleaning tape 70 from the supply reel 58 is let out, each of the supply reel 58, applicator roller 72, and take-up reel 60 rotate in unison. The applicator roller 72 can comprise a resilient material, such as a deformable, tacky elastomeric material, for example. The cartridge 29 is configured so that the supply reel 58 and take-up reel 60 are positioned inside and along the leading edge of the cleaning foot assembly 14, within the perimeter of the steam frame 22 and cover 44. Conversely, the applicator roller 72 is positioned outside and along the leading edge of the cleaning foot assembly 14, protruding beyond the perimeter of the steam frame 22 and cover 44. When the supply reel 58 is completely expended, the spent grout cleaning cartridge 29 can be removed from the foot assembly 14 by releasing the retention features—for example, by unfastening the fasteners or otherwise releasing the retention snaps. The cartridge 29 can then be removed from the bottom of the foot assembly 14 by pulling the cartridge 29 out of the shroud 31 through the opening 42. The spent cartridge 29 can be replaced with a new grout cleaning cartridge 29, which can be installed into the foot assembly 14 by following the cartridge removal steps in reverse order.

A lower portion of the applicator roller 72 forms a contact patch 78 that is exposed below the shroud 31 and adapted to roll cleaning tape 70 across the surface to be cleaned, which can include one or more recessed grooves 80 formed by grout lines between tiles. The contact patch 78 extends below the bottom surface of the steam frame 22 and cleaning pad 28 so that the cleaning tape 70 can protrude down into the grooves 80 and press onto the surface to be cleaned. As previously described, the applicator roller 72 can comprise a deformable, elastomeric material that can compress and re-expand to accommodate height width variations of the surface to be cleaned and the grooves 80. In an alternate configuration (not shown), the applicator roller 72 can be mounted to a vertically slidable, spring-biased pin to further accommodate larger height variations of the surface to be cleaned. The applicator roller 72 further comprises a tacky outer surface so that it maintains engagement with the inner surface 76 of the cleaning tape 70. The width of the applicator roller 72 can generally range from ⅛ inch to ¾ inch depending on the width of the grout groove 80 to be cleaned. It is contemplated that applicator rollers of various widths can be interchangeably mounted to the support frame 56.

The cleaning tape 70 can comprise a substrate comprising a combination of non-woven fibers defining a cleaning surface in the form of a melt-blown sheet material. For example, the tape substrate may include fibers constructed from polypropene, polythene, or poly(ethylene terephthalate) fibers in a variety of alternative percentages by weight in order to form a tape substrate having the desired thickness, durability and performance parameters for the intended grout cleaning application. In one embodiment, the cleaning tape can be approximately ½ to 1 inch wide, although other widths are contemplated depending on the width of the grout groove 80 to be cleaned. Optionally, a user may custom select a specific cleaning tape width depending on his or her grout cleaning requirements.

The cleaning tape 70 and/or the cleaning pad 28 can be impregnated with a specially formulated cleaning composition that includes a dilute hydrogen peroxide component in combination with an anionic detergent that includes an anionic surfactant such as sodium lauryl sulfate, which is more fully described in U.S. application Ser. No. 13/836,630, filed Mar. 15, 2013, now U.S. Pat. No. 9,420,933, titled "Surface Cleaning Apparatus", assigned to BISSELL Homecare, Inc., and which has been previously incorporated by reference in its entirety.

In another embodiment, the cleaning tape 70 can comprise a dissolvable membrane such as polyvinyl alcohol (PVA) or ethylene vinyl alcohol (EV-OH) that is configured to be transferred into a grout groove 80 from a transfer backing that can be collected on the take-up reel 60. The dissolvable membrane can be formulated to dissolve when exposed to a combination of heat and moisture, such as provided by steam from the second steam outlet 27, and can release a cleaning composition as previously described, or other cleaning compositions including a bioactive enzyme, a protective chemistry, or a combination, thereof, for example to further enhance grout cleaning effectiveness. The term "protective chemistry" as used herein can refer to a chemical composition that protects tile and grout from soiling and staining by resisting liquid penetration and can further protect the surface against mildew growth. One representative composition comprising water, methyl hydrogen polysiloxane, octamethylcyclotetrasiloxane, n-octyltriethoxysilane, and trimethylated silica is commercially available as 3M™ Scotchgard™ Tile & Grout Protector.

The second steam outlet 27 is positioned within the support frame 56, rearwardly of the applicator roller 72 and in register with the inner surface 76 of the cleaning tape 70. The second steam outlet 27 can comprise a steam distribution nozzle 82 that is angled downwardly, toward the surface to be cleaned and adapted to distribute a narrow steam jet across the width of the cleaning tape 70. The steam jet can pass through the permeable, non-woven substrate of the cleaning tape 70 to release the impregnated cleaning composition from the cleaning tape 70. Moreover, the steam jet can carry the composition from the tape 70 into the portion of the groove 80 in contact with the outer surface of the cleaning tape 70, directly behind the applicator roller 72, which presses the cleaning tape 70 deep into the recessed grooves 80 of the grout lines in front of the distributor nozzle 82. The heat and/or moisture provided by the steam jet can further activate the cleaning composition on the grout grooves 80 to enhance the cleaning efficacy and accelerate the cleaning process.

In operation, a user prepares the steam appliance 10 by filling the solution reservoir 30 with cleaning liquid, which can include a chemical composition, water, or mixture thereof. The reservoir 30 can be mounted to the handle housing 16 and fluidly connected to the solution conduit 32, which fluidly connects the cleaning solution reservoir 30 to the steam generator 24 for conveying liquid from the reservoir 30 into the steam generator 24. Upon energizing the steam appliance 10, a user can selectively engage the trigger 36 to deliver liquid from the reservoir 30 to the steam generator 24, which heats the liquid passing therethrough to at least 100° C. (212° F.) to generate steam. The steam passes through the first steam conduit 34 to the first steam outlet 26 that distributes steam through the cleaning pad 28 onto the surface to be cleaned. Steam from the steam generator 24 also simultaneously passes through the second steam conduit 27 to the second steam outlet 27.

A user can align the portion of cleaning tape 70 wrapped around the contact patch 78 of the applicator roller 72 within a grout line. The contact patch 78 of the applicator roller 72 presses the inner surface 76 of the cleaning tape 70 down so that the outer surface of the cleaning tape 70 is forced into the recessed grout groove 80, making contact therewith. As the user pushes the steam appliance 10 across the surface to be cleaned, the tacky outer surface of the deformable, elastomeric applicator roller 72 contacts the inner surface 76 of the cleaning tape 70 and rotates forwardly or counter-clockwise as shown in FIG. 4, thereby pulling fresh cleaning tape 70 out from the supply reel 58, which is also forced to rotate counter-clockwise on the first hub 62, in unison with the applicator roller 72, about the first pin 64 of the support frame 56. The deformable applicator roller 72 can compress or expand to accommodate height and width variations of the grout groove 80 and to ensure that the outer surface of the tape 70 is forced into contact with the grout groove 80.

A steam jet from the steam distribution nozzle 82 is forced through the inner surface 76 of the cleaning tape 70 and passes through the permeable tape substrate. A portion of the impregnated cleaning composition is activated and carried with the steam into the grout groove 80 to be cleaned. The cleaning composition is allowed to dwell on the surface for a specified period of time at which point the stains and debris from the surface are released, and the excess cleaning composition with the entrained stain and debris is then reabsorbed into the cleaning pad 28 on the bottom of the foot assembly 14, behind the grout cleaning cartridge 29. Additionally, the cleaning pad 28 can also contain impregnated cleaning composition, which functions in the same manner as previously described.

Eventually, when fresh cleaning tape 70 from the supply reel 58 is fully expended and the take-up reel 60 has collected the spent cleaning tape 70, the spent grout cleaning cartridge 29 can be removed from the opening 42 in the bottom of the shroud 31 and steam frame 22 and a new, unused grout cleaning cartridge 29 can be mounted to the foot assembly 14.

Optionally, the solution reservoir 30 or an auxiliary reservoir (not shown) can distribute a first reactive composition onto the backside of the cleaning tape 70, through the distribution nozzle 82. One example of a first reactive composition described herein for exemplary purposes is tetraacetylethylenediamine (TAED), which can be configured to react with a second composition—namely, the composition that is impregnated into the cleaning tape 70. In operation, when steam and TAED are applied from the distributor nozzle 82 onto the backside of the cleaning tape 70, the steam energy can accelerate the reaction rate and enhance the reaction between the reactive composition and the impregnated composition in the tape 70 to produce significantly enhanced performance. For example, the accelerated reaction can be configured to improve cleaning efficacy or to enhance the application, performance and curing of protective or curable chemistry, such as 3M™ Scotchgard™ Tile and Grout Protector, which can prevent stains, mold and mildew growth on the surface to be cleaned.

While the invention has been specifically described in connection with certain specific embodiments thereof, it is to be understood that this is by way of illustration and not of limitation, and the scope of the appended claims should be construed as broadly as the prior art will permit. For example, the grout cleaning cartridge and portion of the support shroud can be configured to rotate upwardly, away from the front surface of the cleaning foot assembly 14 when not in use to provide unobstructed access to the front edge of the foot assembly. Alternatively, the invention can be reconfigured and applied to a stand-alone hand held steam applicator device, or as a hand-held accessory tool that can be selectively connected to the end of a steam distribution hose on an upright or handheld steam device.

What is claimed is:

1. A grout cleaning cartridge for a surface cleaning apparatus having a steam generator and a foot movable along a surface to be cleaned, comprising:

a housing configured to be replaceable and selectively mounted to the foot;

an applicator roller carried by the housing;

a supply reel rotatably carried by the housing;

a take-up reel rotatably carried by the housing; and a grout cleaning tape provided on the supply reel, wound around the applicator roller, and coupled to the take-up reel, wherein the grout cleaning tape is provided with a grout cleaning composition;

wherein, when the housing is mounted to the foot, advancement of the foot along a surface to be cleaned advances the grout cleaning tape around the application roller and into contact with the surface to be cleaned and wherein each of the applicator roller, supply reel, and take-up reel rotate in unison.

2. The grout cleaning cartridge according to claim 1, wherein steam from the steam generator releases the cleaning composition from the grout cleaning tape onto the surface to be cleaned.

3. The grout cleaning cartridge according to claim 2, wherein the grout cleaning composition comprises water, methyl hydrogen polysiloxane, octamethylcyclotetrasiloxane, n-octyltriethoxysilane, and trimethylated silica.

4. The grout cleaning cartridge according to claim 2, wherein the grout cleaning composition comprises a heat-activated cleaning composition.

5. The grout cleaning cartridge according to claim 4, wherein the grout cleaning tape comprises a dissolvable membrane that is configured to release the cleaning composition when exposed to steam.

6. The grout cleaning cartridge according to claim 2, wherein the grout cleaning composition comprises a hydrogen peroxide component in combination with an anionic detergent.

7. The grout cleaning cartridge according to claim 6, wherein the anionic detergent comprises sodium lauryl sulfate.

8. The grout cleaning cartridge according to claim 1, wherein the grout cleaning tape comprises a substrate of non-woven fibers comprising at least one of polypropene, polythene, or poly(ethylene terephthalate) fibers.

9. The grout cleaning cartridge according to claim 8, wherein the grout cleaning tape comprises a dissolvable membrane that is configured to dissolve when exposed to steam.

10. The grout cleaning cartridge according to claim 9, wherein the dissolvable membrane comprises one of polyvinyl alcohol (PVA) or ethylene vinyl alcohol (EV-OH).

11. The grout cleaning cartridge according to claim 1, wherein the applicator roller comprises a deformable elastomeric material configured to accommodate height variations of the surface to be cleaned.

12. The grout cleaning cartridge according to claim 1, wherein the applicator roller comprises a tacky outer surface that engages the grout cleaning tape.

13. The grout cleaning cartridge according to claim 1, wherein the supply reel comprises a first hub that is rotatably mounted to a first support pin on the housing, and the take-up reel comprises a second hub that is rotatably mounted to a second support pin on the housing.

14. The grout cleaning cartridge according to claim 1, wherein the grout cleaning tape comprises a steam-permeable substrate.

15. The grout cleaning cartridge of claim 1 wherein the housing is in register with a steam outlet fluidly coupled to the steam generator.

16. A grout cleaning cartridge for a surface cleaning apparatus having a steam generator and a foot movable along a surface to be cleaned, comprising:

a housing configured to be detachably mounted to the foot in register with a steam outlet fluidly coupled to the steam generator;

an applicator roller carried by the housing;

a supply reel rotatably carried by the housing;

a take-up reel rotatably carried by the housing; and a grout cleaning tape provided with a grout cleaning composition, the grout cleaning tape provided on the supply reel, wound around the applicator roller, and coupled to the take-up reel;

wherein, when the housing is mounted to the foot, the grout cleaning cartridge is configured to allow steam from the steam outlet to pass through the grout cleaning tape onto the surface to be cleaned; and advancement of the foot along the surface to be cleaned advances the grout cleaning tape around the application roller and into contact with the surface to be cleaned, transferring the grout cleaning composition from the grout cleaning tape to the surface, and after the grout cleaning composition has been transferred a remainder of the grout cleaning tape is collected on the take-up reel.

17. The grout cleaning cartridge according to claim 16 wherein the grout cleaning tape comprises a steam-permeable substrate.

18. The grout cleaning cartridge according to claim 16 wherein the grout cleaning tape comprises a dissolvable membrane that is configured to dissolve when exposed to steam.

19. The grout cleaning cartridge according to claim 18, wherein the dissolvable membrane comprises one of polyvinyl alcohol (PVA) or ethylene vinyl alcohol (EV-OH).

20. The grout cleaning cartridge according to claim 16, wherein the grout cleaning composition comprises a heat-activated cleaning composition.

* * * * *